US007918510B2

(12) United States Patent
van den Nieuwboer et al.

(10) Patent No.: US 7,918,510 B2
(45) Date of Patent: Apr. 5, 2011

(54) PATHOLOGY RELATED INDIVIDUAL MODULAR ORTHOPEDIC SEATING SYSTEM

(76) Inventors: Johanna Hendrika van den Nieuwboer, Haaksbergen (NL); Jacob de Vries, Boekelo (NL)

( * ) Notice: Subject to any disclaimer, the term of this patent is extended or adjusted under 35 U.S.C. 154(b) by 0 days.

(21) Appl. No.: 11/881,127

(22) Filed: Jul. 25, 2007

(65) Prior Publication Data

US 2008/0185899 A1 Aug. 7, 2008

Related U.S. Application Data

(60) Provisional application No. 60/836,292, filed on Aug. 8, 2006.

(51) Int. Cl.
*A47C 7/00* (2006.01)
*A47C 7/02* (2006.01)

(52) U.S. Cl. ..... 297/452.27; 297/440.14; 297/452.26

(58) Field of Classification Search ..... 297/452.11, 297/452.14, 452.16, 452.17, 452.22, 452.32, 297/452.27, 440.14, 452.26–452.28
See application file for complete search history.

(56) References Cited

U.S. PATENT DOCUMENTS 2,847,061 A * 8/1958 Morton ..... 297/452.28
3,124,389 A * 3/1964 Mikan ..... 297/452.17
3,165,355 A * 1/1965 Hitchcock, Jr. et al. ... 297/216.1
3,568,225 A * 3/1971 Radke ..... 5/653
3,751,111 A * 8/1973 Taylor et al. ..... 297/452.27
4,522,447 A * 6/1985 Snyder et al. ..... 297/452.27
4,673,216 A * 6/1987 Alfer ..... 297/452.27
4,753,480 A * 6/1988 Morell ..... 297/452.27
4,828,325 A * 5/1989 Brooks ..... 297/452.28
4,890,235 A * 12/1989 Reger et al. ..... 700/118
4,998,354 A * 3/1991 Silverman et al. ..... 33/514.2
5,018,790 A * 5/1991 Jay ..... 297/452.26
5,062,677 A * 11/1991 Jay et al. ..... 297/440.2
5,105,489 A * 4/1992 Meyer ..... 5/652
5,193,285 A * 3/1993 Heinrich et al. ..... 33/514.2
5,407,248 A * 4/1995 Jay et al. ..... 297/284.1
5,470,590 A * 11/1995 Brubaker et al. ..... 425/2
5,647,637 A * 7/1997 Jay et al. ..... 297/354.12
5,857,749 A * 1/1999 DeBellis et al. ..... 297/452.41
6,611,980 B2 9/2003 Wempe

* cited by examiner

*Primary Examiner* — David Dunn
*Assistant Examiner* — Tania Abraham
(74) *Attorney, Agent, or Firm* — MacMillan, Sobanski & Todd, LLC

(57) ABSTRACT

A wheelchair sit-system with a three dimensional anatomical shape, which can accomplish an equal as well as an unequal pressure/load distribution, stabilize the pelvic base and trunk, compensate sit pathology, and be individually adapted on the basis of treatment of specific sit complaints/impairments. The wheelchair sit system (i.e., a sit cushion and a backrest) is developed methodically via inventory of the three dimensional pelvis/trunk measures; design a three dimensional drawing of basic sit cushions and backrest models in three sizes (S, M and L); specification of the sit pathology of the pelvis and trunk; and modification of the designed three dimensional basic sit cushion and backrest models on the basis of sit pathology. A product development trajectory results in nine sit cushion models in three sizes (S, M and L); six backrest models in three sizes (S, M and L); one generic sit cushion, with inserts, in three sizes (S, M and L); and one generic backrest, with inserts, in three sizes (S, M and L). The assortment of sit cushions and backrest models is applied via a prescription procedure has been developed.

20 Claims, 14 Drawing Sheets

| Measure | Height cm | Width | Distance to vertical |
|---|---|---|---|
| Plane (mid-sacral) | 8 | 33 - 40 | 0 |
| Plane (crista) | 20 | 31 - 37 | 3.5 |
| Plane (th 12) | 34 | 28.5 - 32.5 | 2.5 |
| Plane (th 7) | 50 | 31.5 - 36.5 | 0 |
| Plane (th 3) | 61 | 34 - 40 | 1.5 |

PATHOLOGY RELATED INDIVIDUAL MODULAR ORTHOPEDIC SEATING SYSTEM

CROSS REFERENCE TO RELATED APPLICATIONS

This application claims the benefit of U.S. Provisional Patent Application No. 60/836,292, filed on Aug. 8, 2006.

BACKGROUND OF INVENTION

This invention relates in general to a seating system for treating sit complaints and sit impairments, especially decubitus ulcers.

The body-weight functions as an acting force when lying down and sitting. This force is distributed over the contact area that the body has with the supporting surface. The quotient of force and contact area is pressure, as shown in FIG. 1. The larger the contact area the lower the local pressure. A pressure value less than 60 mmHg seldom causes complaints or impairments. A pressure greater than 60 mmHg usually results in an awareness of pain when the pressure is sustained over a longer period of time. Regularly changing the lying or sitting position reduces or prevents pain. However, a pressure greater than 100 mmHg compresses the subcutaneous microcirculation. This can lead to irreversible skin or soft tissue damage, resulting in decubitus ulcers. Actually, the pain and decubitus, or a threat of decubitus, is not so much an expression of excessive pressure, but more of excessive local loading, which is expressed as the product of pressure and time.

In sitting, the acting force (i.e., the body-weight) is not usually applied perpendicularly but at an angle to the supporting surface and therefore a shear force is generated, as shown in FIG. 2. Because of this non-perpendicular loading people have the tendency to slide away. An abnormal sitting position can be prevented by active posture correction, which is based on the capability of a person to execute motor control over body functions (e.g., joints, muscles, etc.). In patients with no or a decreased capability of motor control over the body functions (e.g., joints, muscles, etc.) sitting and lying becomes a problem and causes complaints.

The potential efficacy (i.e., a non critical load and adequate sit stability) of wheelchair seating systems can be derived from above mentioned biomechanical starting points of local deloading and stabilizing of the body in place. In general, patients with wheelchair sit-complaints/impairments are treated with a standard sit-cushion. When this treatment is not successful, unless some alternative treatment is applied, this leads to chronic recitative wheelchair sit complaints.

Standard sit-cushions and backrests are manufactured (in series) as off-the-shelve products. The following are characteristics/limitations of present standard sit cushions not anatomically (i.e., three dimensional) shaped, or limited anatomical shape; not specifically designed for/suitable for an unequal load distribution over the buttocks; not specifically designed to achieve pelvic stability; and not specifically designed to compensate sit pathology.

The characteristics/limitations of the present standard sit cushions frequently cause the situation that treatment of wheelchair sit complaints/impairments via standard sit cushions do not deliver a positive medical treatment result, in other words lead to chronic/recitative sit complaints/impairments.

SUMMARY OF INVENTION

A seating system comprises a three dimensional anatomically shaped that design is specifically designed for the range of three dimensional pelvic/trunk measures (i.e., sit-cushion and backrest measures), that is specifically designed for unequal and non-critical load distribution over the buttocks and back that is specifically designed for an adequate pelvic and trunk stability; and that is specifically designed to compensate present sit pathology.

Various aspects of this invention will become apparent to those skilled in the art from the following detailed description of the preferred embodiment, when read in light of the accompanying drawings.

DETAILED DESCRIPTION

I. Introduction

Figure 1:
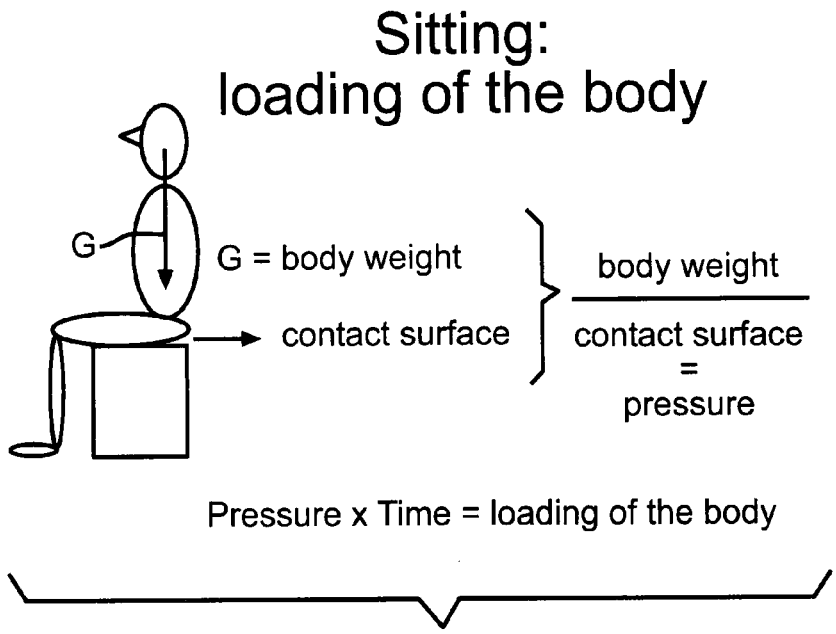
FIG. 1 is a prior art diagrammatic representational view of pressure as the quotient of force and contact area.
Figure 2:
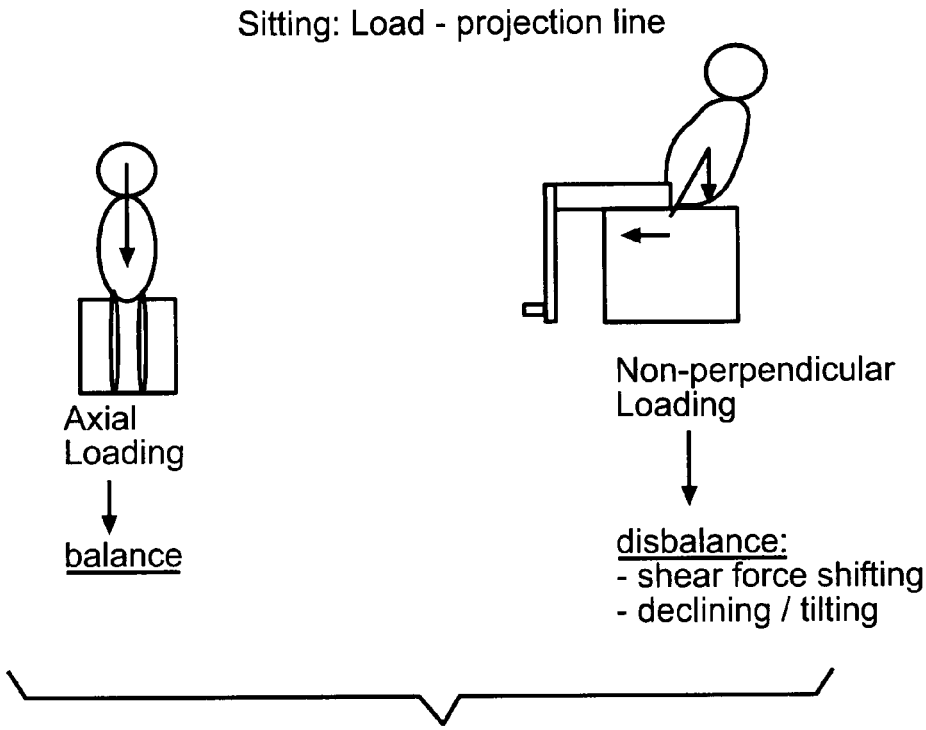
FIG. 2 is a prior art diagrammatic representational view of acting force (i.e., the body-weight) applied at an angle to a supporting surface to generate a shear force.
Figure 3:
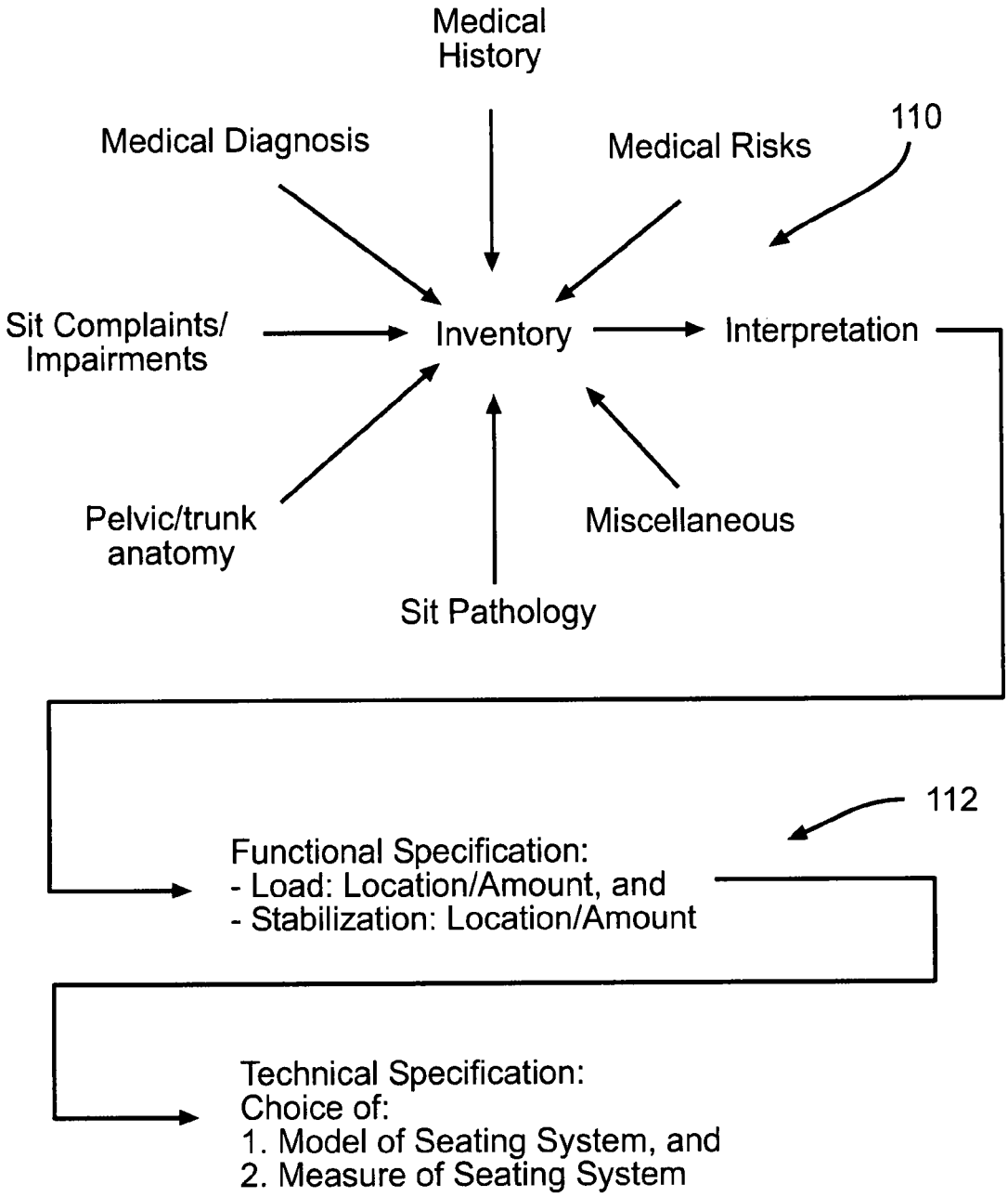
FIG. 3 is a diagrammatic representational view of a method of application of a seating system to a user.
Figure 4:
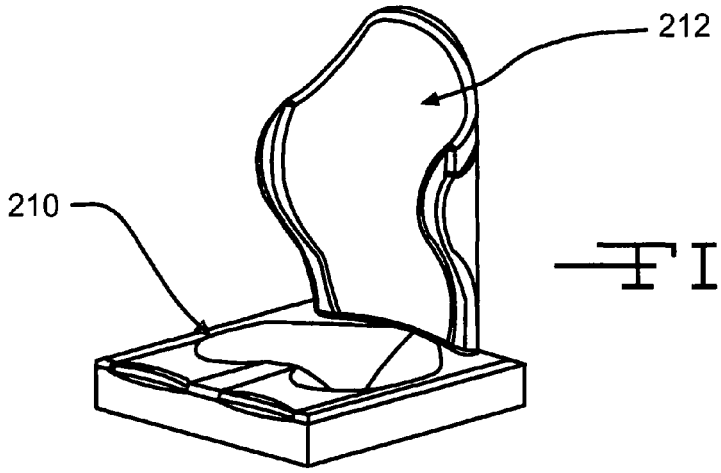
FIG. 4 is a perspective view of a (pathology-related) model of a sit-cushion and a perspective view of a (pathology-related) model of a backrest.

Now with reference to the drawings, particularly FIG. 3, there is illustrated an exemplary method for applying a seating system to a user that may comprise the steps of diagnosing sit complaints or impairments, as indicated at function step 110, and treating the sit complaints or impairments, as indicated at function step 112, with a sit-cushion and/or a backrest comprised of orthopedic modules 210, 212, as shown in FIG. 4, that may be pathologically related to the unique anatomical shape of the user.

II. Sit Complaints and Impairments

The most prevalent sit complaints may be complaints of pain, the feeling of instability, and tiredness or fatigue. The most prevalent sit impairments may be complaints related to the threat of decubitus ulcers, which may be apparent from red skin, decubitus ulcers, or sliding away, which may result from instability.

Sit complaints and impairments may be an expression of an abnormal magnitude and/or direction of a load when seated. The inability to change the seated position (e.g., in a wheelchair) often results in the experience of pain at those places or points where the bony parts of the skeleton of the sitting area (e.g., the tubera, trochantera and sacrum) and to a lesser extent the back (e.g., the scapula, processus spinosus, crista iliaca) are prominent (see FIGS. 5 and 6). Localized excessive loading usually may cause localized (i.e., tuber) pain or otherwise pain in a certain region. This localized excessive loading can cause not only pain but also decubitus ulcers. The chance that this occurs may increase with the duration and the severity of the excessive loading. To offset the load when sitting, the skin and the soft tissues of the buttocks and the back may be loaded, as will be described below. There are different factors which are of influence on the load-ability, such as muscle volume, muscle tone, skin atrophy, and the metabolism. When the balance between the loading and the load-ability of the buttocks and the back is disturbed, then there may be a risk of localized excessive loading complaints, such as pain and/or decubitus ulcers.

Not only may the magnitude of the load be influenced by sitting but also the direction of that loading. In general, the tendency may be to slide away as a consequence of instability. This may take place when a person is not able or is insufficiently able to correct a changing body posture. Corrections of the body posture are often attempted and often do not give the required result. These attempts require a lot of effort (i.e., energy) for the person and generate tiredness or fatigue.

Instability may present greater problems especially with users that are completely or nearly completely wheelchair-bound. Often these users have one of the following diagnoses: spinal cord lesion, severe stroke or contusio cerebri, cerebral palsy, congenital skeleton diseases, spina bifida, or neuromuscular or degenerative diseases.

III. Diagnostics of Wheelchair Sit Complaints/Impairments

Diagnostics of sit complaints of wheelchair users may be difficult because such users typically fail to mention pain they encounter when sitting, pain being an accompaniment to sit complaints or because they cannot feel pain (e.g. in spinal cord laesions). A doctor or seating expert frequently does not inquire specifically about a user's pain. For an abnormal sitting posture, the same holds true. This problem is also insufficiently recognized because it is not taken seriously.

When diagnosing wheelchair users, a consistent and accurate inquiry should be made about the kind of sit complaints or impairments the user endures. Most prevalent complaints or impairments may be pain, decubitus ulcers or a threat thereof, instability or tiredness. In connection with this inquiry, an inspection of the buttocks (e.g., for skin defects) and sitting posture (e.g., sliding away) may be performed. Last mentioned, palpation at the height of the bony prominent skeleton parts (e.g., putting a hand under a loaded buttock at the height of the tubera) may give possible insight into the differences of localized loading and can as such be an explanation, at least in part, for the sit complaints and impairments that are present.

The above mentioned subjective diagnostics (i.e., inquiry, inspection and palpation) can be objectified by carrying out a sit load analysis. A sit load analysis can give an objective insight into the magnitude and direction of the seated load and can make it possible to make a distinction between critical loading (i.e., accompanied by risk) and a non-critical loading (i.e., without risk). In a sit load analysis, specific clinical software can be applied to process pressure measurement data obtained via a protocolled pressure measurement in time in order to acquire relevant clinical outcome data. The sit load analysis program may calculate the seated load (e.g., of the seat and back) and determine the medical risks of seating. As such, sit complaints and impairments can be objectified.

IV. Treatment of Wheelchair Sit Complaints and Impairments

Starting Points

The treatment of wheelchair sit complaints and impairments may exist out of the application of a load related wheelchair seating system. Starting from a load related treatment, the treatment of the excessive local overload at the buttocks and/or back should result in a local or regional pressure relief at the buttocks and/or back. A localized deloading can be achieved on the one hand, through the provision of a contact area that should be as large as possible between the seat and/or backrest and the body and on the other hand, through the realization of a redistribution of the load (at the level of the contact area) on the principle of a non-equal pressure and loading distribution. In practice, the latter may be with respect to the reduction of the load at the level of the bony prominent skeleton parts and the scar regions and a selective loading of soft tissues and body parts, which can endure more load (e.g., the dorsal side of the upper legs and the gluteus region).

Figure 5:
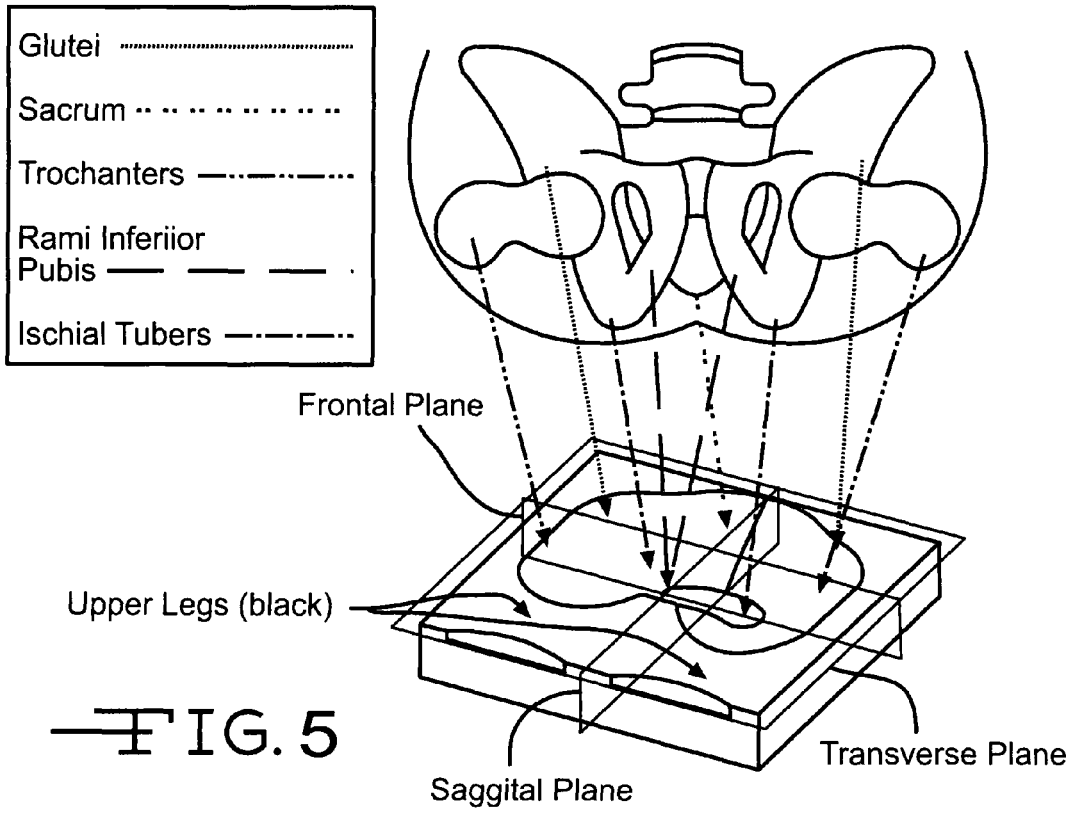
FIG. 5 is an enlarged perspective view of the sit-cushion shown FIG. 4 and a diagrammatic representational view, in elevation, of the bony parts of the user's anatomy with arrows indicating where the user often experiences pain.
Figure 6:
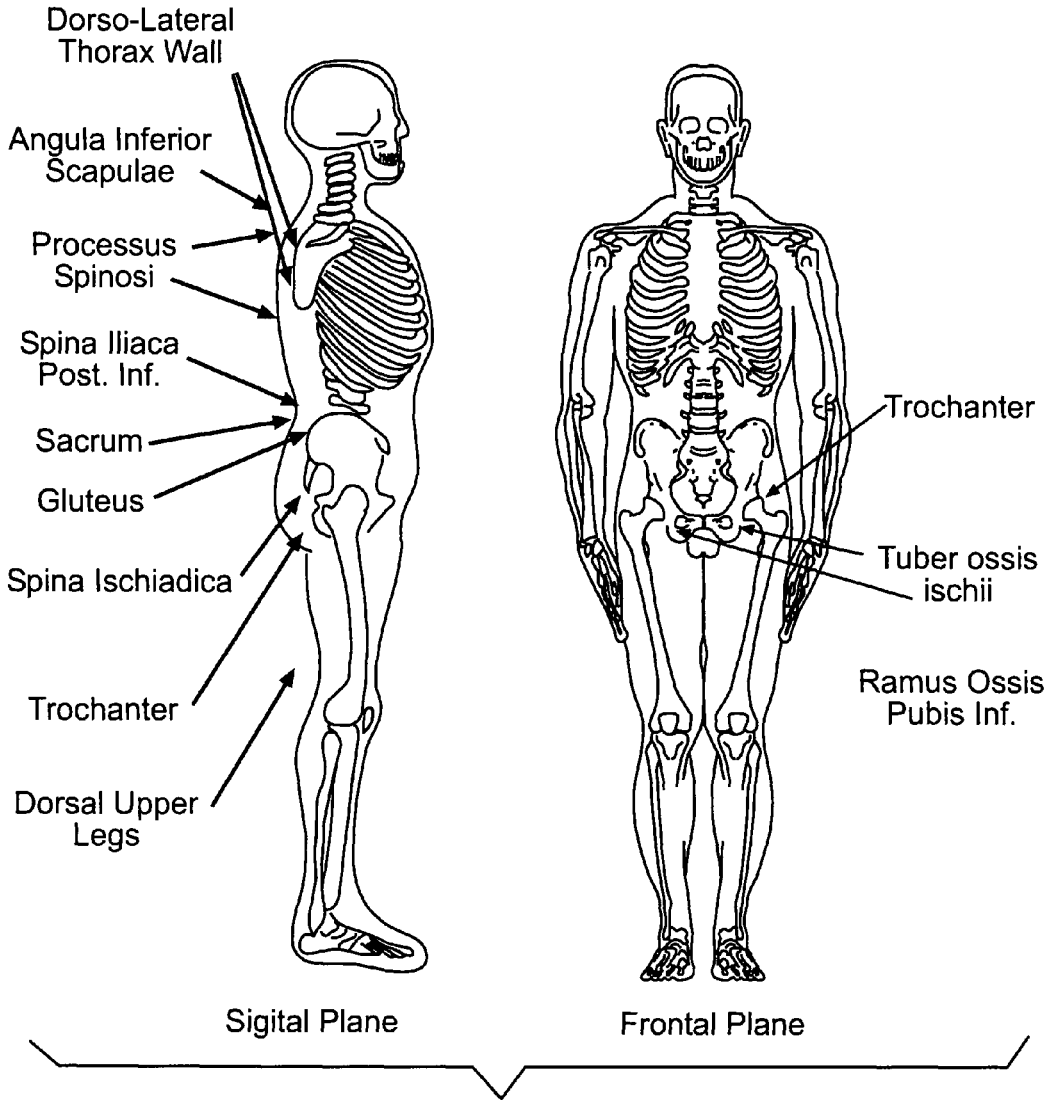
FIG. 6 are diagrammatic representational views of the user's prominent skeletal parts of pelvis and trunk in the frontal and sagittal plane, with examples of deloading area's labeled in italic font and loadable area's labeled in bold font.

In the treatment of instability, the seat should stabilize the pelvic base (i.e., the bottom view of the pelvis) directly or indirectly (in the frontal, the sagittal and the transversal planes (see FIGS. 5 and 6). In the pelvic base stabilization, a reduction of local overload (e.g., the tuber) should be taken into account.

There may be a few bony and soft tissue structures available to stabilize the pelvic basis in the frontal and the sagittal planes. These may be supportive areas.

Pelvic stability can also be influenced via the back in the sagittal plane. Trunk stability can be influenced via the back in the frontal, sagittal and transversal planes. This can be accomplished, as in the pelvic base stabilization, by using certain loadable supportive areas. In the stabilization of the pelvis (i.e., pelvic base stabilization) and the trunk, not only the supportive areas are considered, but also an optimal contact area is considered.

V. Design of the Seating System on the Base of Design Targets

Design Trajectory of the Sit-Cushion:

A. Inventory of three dimensional pelvic measures (e.g., prominent skeletal parts of the pelvic base). This may be done with the help of patient load analysis data (registration of three dimensional pelvic base measures), and using the measures of three dimensional experimental sit-cushions.

Result: Range of pelvic measures of prominent skeletal parts of the pelvic base may be in the frontal, sagittal and transversal planes.

B. Design (three dimensional drawing) of the basic sit cushion (models) may be in three measures: small, medium and large (S, M and L).

Figure 7:
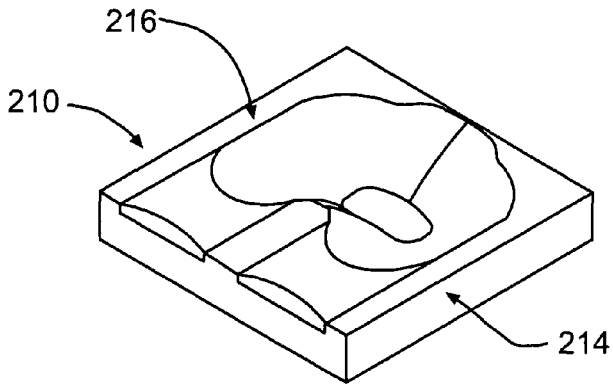
FIG. 7 is a perspective view of an example of a medium size sit-cushion/pelvic base (i.e., a three dimensional basic pelvic sit shape).

The basic three-dimensional shape of a sit-cushion module 210, which may be made up of a left bottom half 214 and a right bottom half 216, as shown in FIG. 7, may be designed on the basis of the outcome of the inventory study of three dimensional pelvic base measures (see A above).

To simplify the sit-cushion assortment, three different size models (sit shapes) may be described, namely small, medium, and large (S, M and L) size models. These sizes may be based on measures in the transversal, frontal and sagittal plane. That is to say, the width of the each size model may be based on the hip width of the user. For the three model sizes, the hip widths chosen, for example, may be:

| | |
|---|---|
| S | 35 cm, |
| M | 38.5 cm, and |
| L | 42 cm. |

Figure 8:
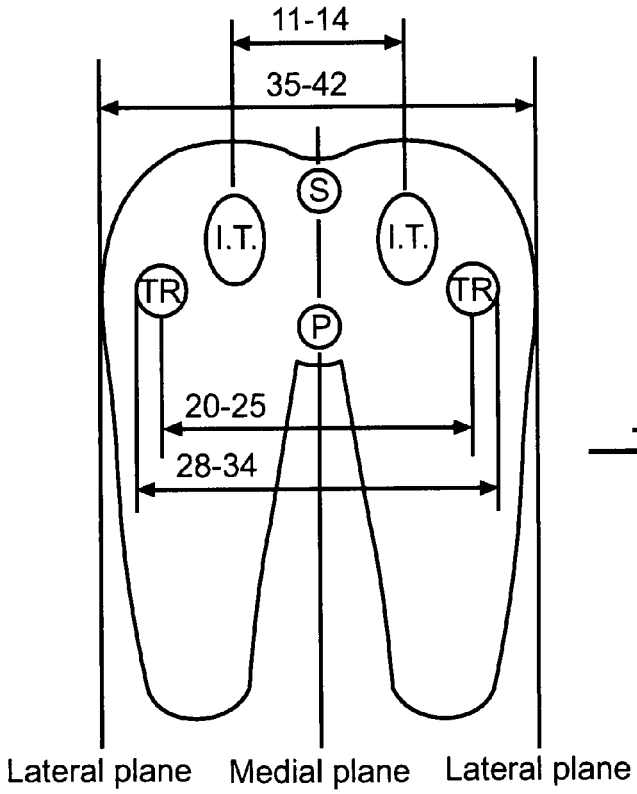
FIG. 8 is a diagrammatic representational top plan view showing the width measures (i.e., design) of the anatomical landmarks of the pelvic base with the outer trochanter (TR) measure being a clinical measure.

The widths chosen may be based on the range of hip widths, derived from the patient load analysis data with pelvic base measures (see FIG. 8). Also, the following three dimensional-pelvic measures may be based on the patient load analysis data (see A above).

Next, the width of the ischial tuberosities (IT) may be scheduled (see FIG. 8) on behalf of the three sizes. The IT widths may be determined, for example, as:

| | |
|---|---|
| S | 11 cm, |
| M | 12.5 cm, and |
| L | 14 cm. |

The mean of the trochanter width may be, for example, 22.5 cm (i.e., central trochanter). This may be a design measure and should not be confused with a clinical outer trochanter measure. This may be scaled linearly with a total hip width. The average trochanter width (see FIG. 8) of 22.5 cm may be corresponding with the average total hip width of, for example, 38.5 cm. The percentage of increase, between the medium total width and the large total width, may be also applied on the trochanter width. The trochanter widths, may be, for example, therefore:

| | |
|---|---|
| S | 20 cm, |
| M | 22.5 cm, and |
| L | 25 cm. |

Figure 9:
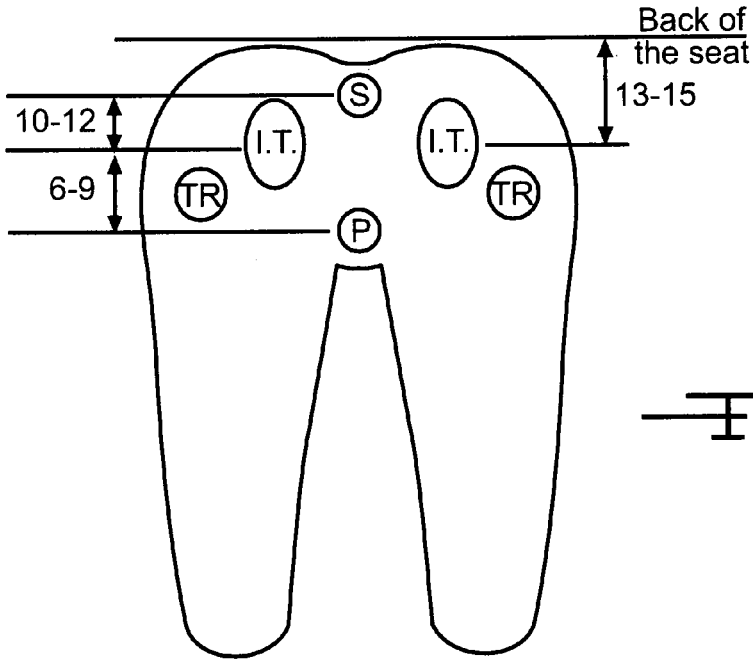
FIG. 9 is a diagrammatic representational top plan view showing the length measures of the anatomical landmarks of the pelvic base.

The distance of the IT to the rear end (i.e., the back of the seat) may vary, for example, between 13 and 15 cm (see FIG. 9). This may depend on the sitting position. If the pelvis is tilted forward, the IT's may position more to the rear. If the pelvis is tilted backward, the IT's may position more to the front. The following sizes have been chosen, for example, as:

| | |
|---|---|
| S | 13 cm (to the sacrum: 9 cm), |
| M | 14 cm (to the sacrum: 10 cm), and |
| L | 15 cm (to the sacrum: 11 cm). |

The distance between the pubis P and the sacrum S may vary (see FIG. 9) between, for example, 16.5 cm and 20.5 cm. This may lead to the following sizes:

| | |
|---|---|
| S | 16.5 cm, |
| M | 18.5 cm, and |
| L | 20.5 cm. |

The mean of the sacrum pubis distance (SP) may be 18.5 cm.

Analyses of these measures may be derived form anthropometric data (e.g., physical measures of pelvises in place and pelvic measures derived from sit pressure measurements/sit load analyses of patients).

Figure 10:
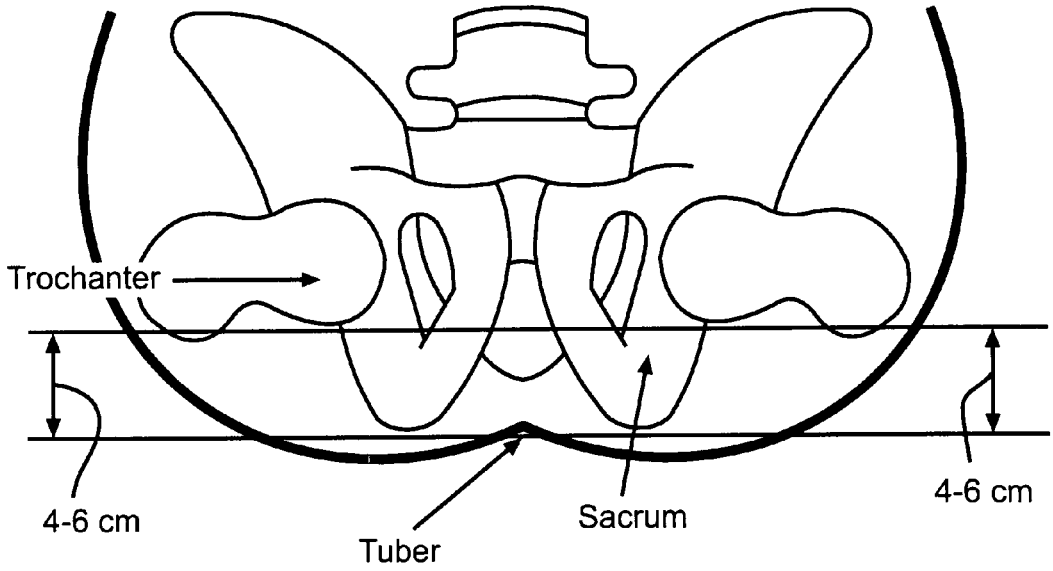
FIG. 10 is a diagrammatic representational view, in elevation, showing the depth measures of the anatomic landmarks, trochantera, tubera and mid sacrum in the frontal plane.

In the frontal plane, the depth position of the tubera, trochantera and sacrum may differ, as shown in FIG. 10. The distance between the tuber and the trochanter may vary, for example, between 4 cm and 6 cm. This may lead, for example, to the following sizes:

| | |
|---|---|
| S | 4 cm, |
| M | 5 cm, and |
| L | 6 cm. |

The distance tuber-sacrum (distal part of the sacrum) may vary, for example, from 4-6 cm (sitting in a relaxed position with a slight lumbar lordosis) and this may lead to the following sizes:

| | |
|---|---|
| S | 7 cm, |
| M | 9 cm, and |
| L | 11 cm. |

Starting with the above mentioned three dimensional pelvic measures, S, M and L basic sit-cushion models may be developed/built up. FIG. 7 shows, for example, the M model (i.e., the medium model).

C. Specification of Sit Pathology of the Buttocks Per Pelvic Half

The sit pathology of the buttocks (i.e., excessive local loading and/or instability) can be specified per pelvic half (left and right, respectively), using the patient load analyses data, whereby for example local overloading may:

concern in 75% of the cases: the tuber/sacrum;

concern in 35% of the cases: the trochanter;

concern in less than 10% of the cases: the remainder of the buttocks, upper legs, glutei, and rami inferiors; and sit instability may occur:

in the sagittal plane: up front/backwards;

in the frontal plane: to the left/to the right; and in the transversal plane: rotation to the left/right.

Result: Quantitative insight in the location and the severeness of the local overloading, and/or the extent and direction of the sit instability in the three planes.

Figure 11A:
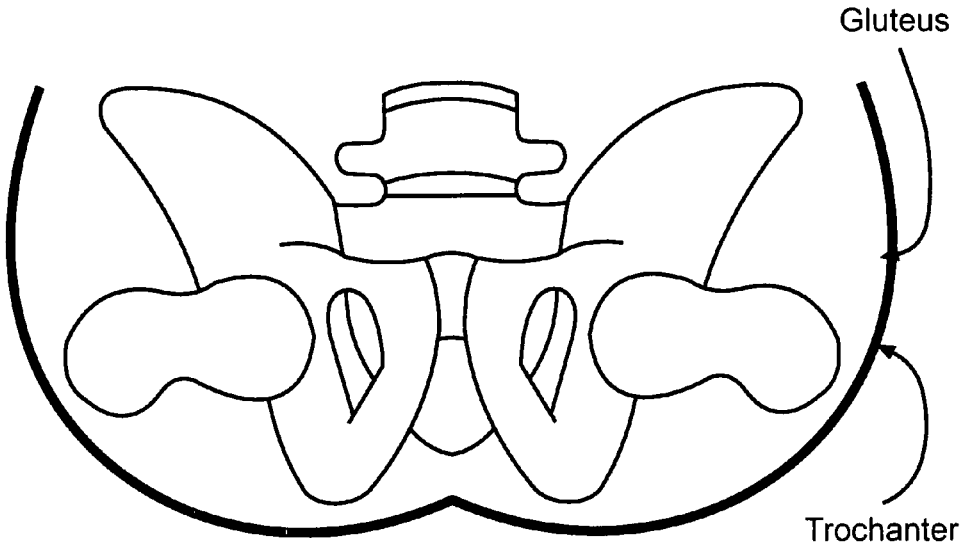
FIG. 11A is a diagrammatic representational view, in elevation, showing the pelvic base and the anatomical landmarks in the frontal plane stabilizing the pelvis.
Figure 11B:
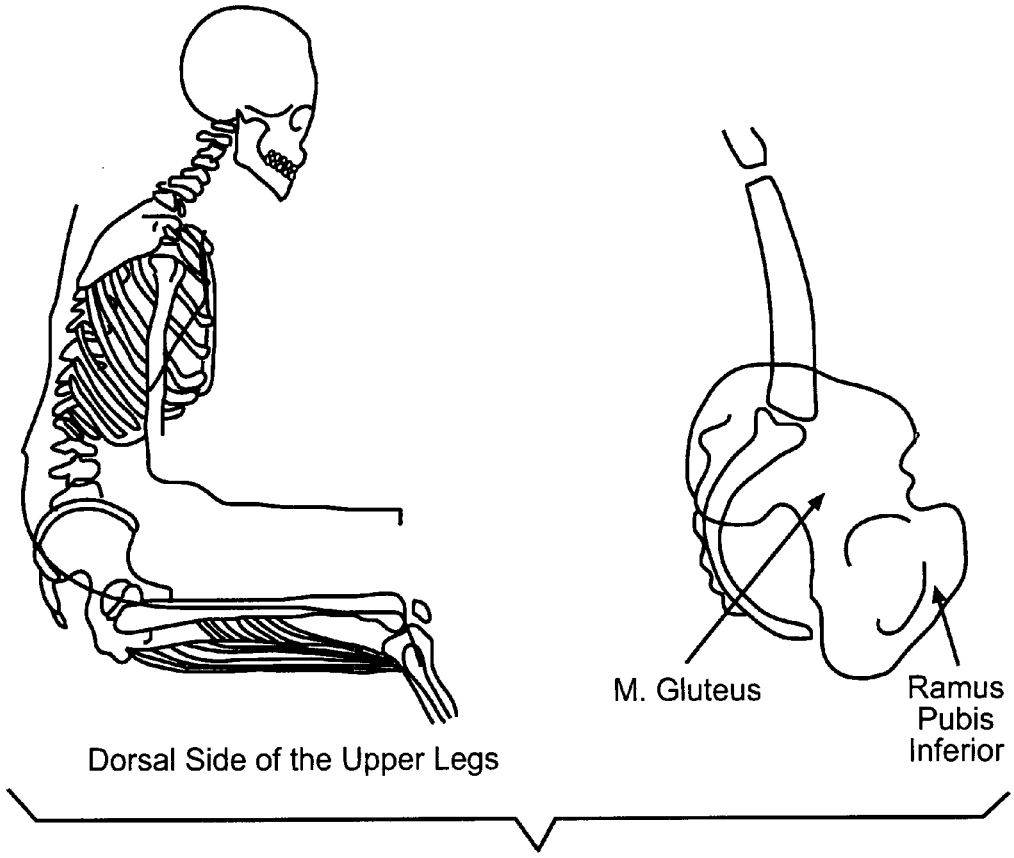
FIG. 11B are diagrammatic representational views, in elevation, showing the anatomical landmarks in the sagittal plane stabilizing the pelvis.

The following regions or structures of the module (i.e., the left bottom half and the right bottom half), using patient load analyses data, can be used as loading options: the trochantera, the musculus glutei, the rami inferiores ossis pubis, and the dorsal side of the upper legs (see FIG. 6.). These loading options are not only useful within the framework of an unequal pressure and loading distribution of the buttocks but also for the stabilization (see FIGS. 11A and 11B) of the pelvic base in the frontal plane (via the trochantera and the musculus gluteï) and the sagittal plane (via the musculus gluteï, the rami inferioris ossis pubis, and the upper legs). This may be done on behalf of a sit instability in the frontal and/or sagittal plane.

D. Modification of the Designed Three Dimensional Basic Sit Cushion Model Per Pelvic Half On the basis of the insight in the sit pathology (see C above), modifications may be applied in the design of the basic sit-cushion model half.

Modification of the basic sit-cushion model half (with standard loading) on behalf of the treatment of local overloading, may be, for example, as follows:

extra deloading of the tuber(a) and sacrum (this is a standard form of treatment); and the option for extra deloading of the trochanter.

Modification of the basic pelvic sit module on behalf of the treatment of sit instability, may be, for example, as follows:

in the sagittal plane, the option for extra support at the height of the glutei; and in the frontal plane, the option for extra support at the height of the glutei.

The above mentioned modifications of the three dimensional basic pelvic sit shape half have experimentally (from a bio-mechanical perspective) taken place and were judged on their effect on the local sit loading and sit stability by means of sit load analysis in a representative group of subjects. Guided by the results, sit loading profiles with a non critical load distribution over the buttocks and an adequate sit stability (loading less than 60 mm Hg, shift the center of pressure (COP), as it relates to pressure mapping (i.e., in the plane of the pressure map), such as in the pressure mapping systems available from Tekscan, Force Sensing Array (FSA) from Vista Medical, X-Sensor and Novell, over both axis less than 0.20 cm) have been accomplished.

To simplify the prescription, three basic half models may be sufficient. The three basic half models may be alike with respect the deloading of the tubera and the sacrum but may differ to the extent in which the musculi gluteï and the trochantera may be loaded, for example, as follows:

Pelvic half model 1 (see FIG. 12): standard gluteus loading and standard trochanter loading;

Pelvic half model 2 (see FIG. 13): extra gluteus loading and standard trochanter loading; and Pelvic half model 3 (see FIG. 14): extra gluteus loading and trochanter deloading.

The modifications of the three dimensional sit-cushion model half may make it possible to achieve an unequal load distribution over the buttocks with a non-critical sit loading (i.e., treatment of local overload) and, at the same time, an adequate sit stability.

As far as a pelvic half model does not necessarily realize a non-critical load/adequate sit stability, the remaining overload/sit instability can be solved via an adaptation of the cushion. Material (e.g., foam) and construction of the cushion may be suitable for adaptation.

Based on the results of the sit analysis of a patient sitting on a preselected cushion shape, the cushion (e.g., foam base) can be adapted locally by grinding the foam base and/or adding specific inserts: a sacrum bridge (for deloading of the sacrum in the sagittal plane), a buttock bank (for deloading of the sacrum, stabilizing the pelvis in the sagittal plane), a hip endo/exo facilitator (for treatment of spasm), a hip endo/exo preventor (for treatment of hypotone thigh muscles), a sagittal wedge (for treatment of stability of the body in the sagittal plane), a frontal wedge, (for treatment of stability in the frontal plane), a diagonal wedge (for treatment of stability in the frontal and transversal plane simultaneously), and a rotation block (for treatment of the rotated pelvis in the transversal plane).

Figure 12:
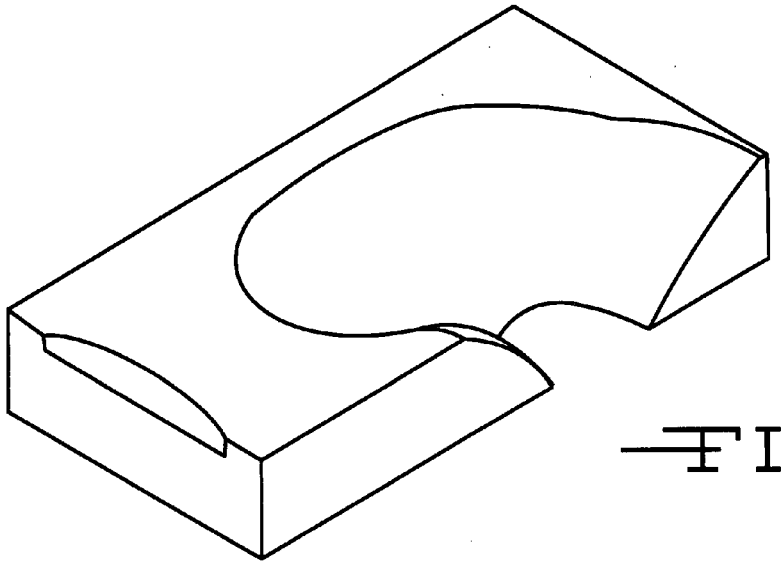
FIG. 12 is a perspective view of pelvic half model 1 (i.e., the right side) with standard gluteus and standard trochanter loading.
Figure 13:
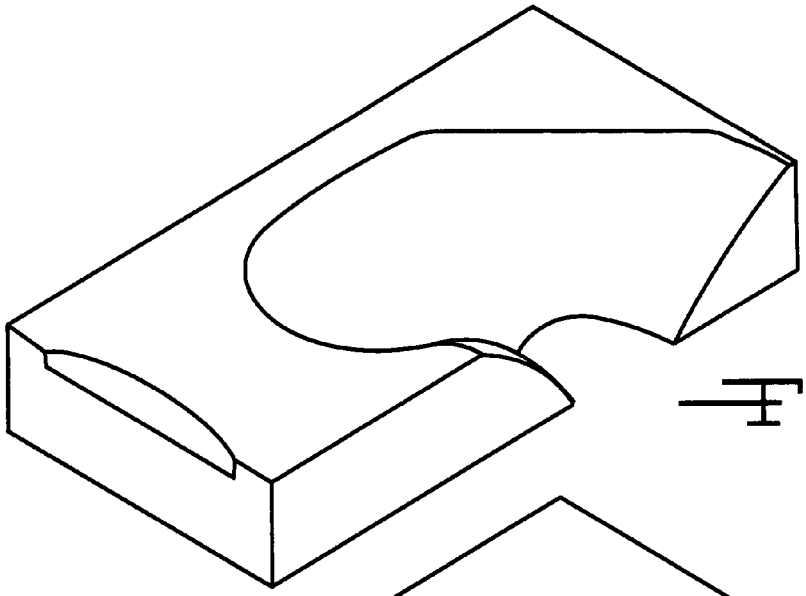
FIG. 13 is a perspective view of pelvic half model 2 (i.e., the right side) with extra gluteus and standard trochanter loading.
Figure 14:
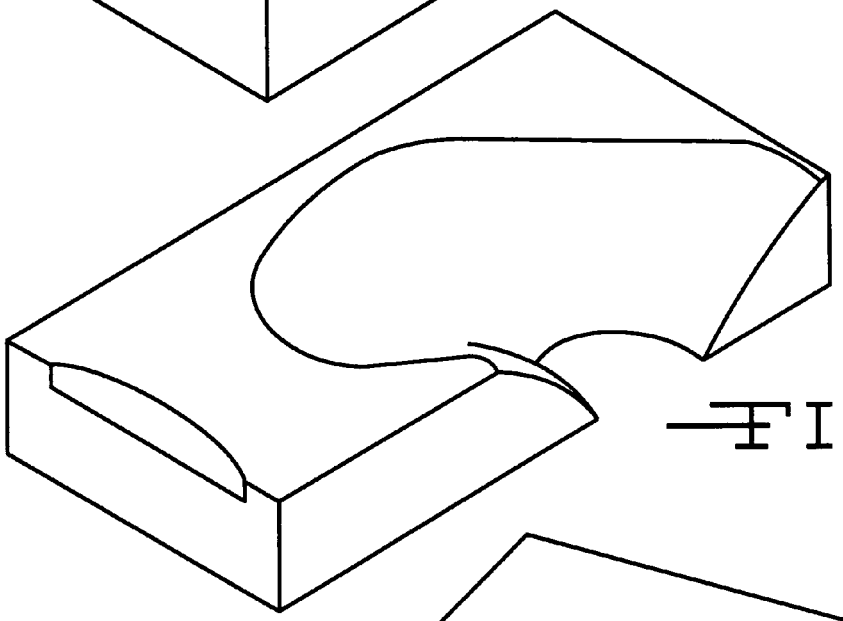
FIG. 14 is a perspective view of pelvic half model 3 (i.e., the right side) with extra gluteus loading and trochanter deloading.

The pelvic half models are respectively illustrated, for example, in FIGS. 12-14.

Because a half model should be selected for per each pelvic half (i.e., the left bottom half and the right bottom half), there may be a total of nine different sit-cushion models, as set forth, for example, in the matrix that follows:

| | | |
|---|---|---|
| 1/1 | 1/2 | 1/3 |
| 2/1 | 2/2 | 2/3 |
| 3/1 | 3/2 | 3/3 |

Three symmetric cushion models may be presented, for example, as set forth below:

| | | |
|---|---|---|
| 1/1 | 2/2 | 3/3 |

Through the nine sit-cushion models (above), local overload of the tubera and sacrum can be treated. In the case of a trochanter overload, pelvic half model 3 may be applied. The extra gluteus load may provide sit stability in the sagittal plane (see FIG. 11B).

If the trochanter region can be loaded normally, pelvic half model 1 or 2 may be selected. In the case of gluteus hypotonus or atrophy and/or pelvic instability in the sagittal and frontal planes, the gluteus region can be loaded more, via pelvic half model 2. This may stabilize (see FIGS. 11A and 11B) the pelvis in the sagittal and frontal plane (also some contribution of trochantera).

In all three pelvic base half models, the rami inferiores ossis pubis and upper legs may be subjected to the same degree of loading. This may contribute to the pelvic base stability in the sagittal plane.

The combination of the nine pelvic half models, left and right (L and R), and the three sizes (S, M and L) of these models may result in twenty seven (3×9) pelvic half models (L and R).

Figure 15:
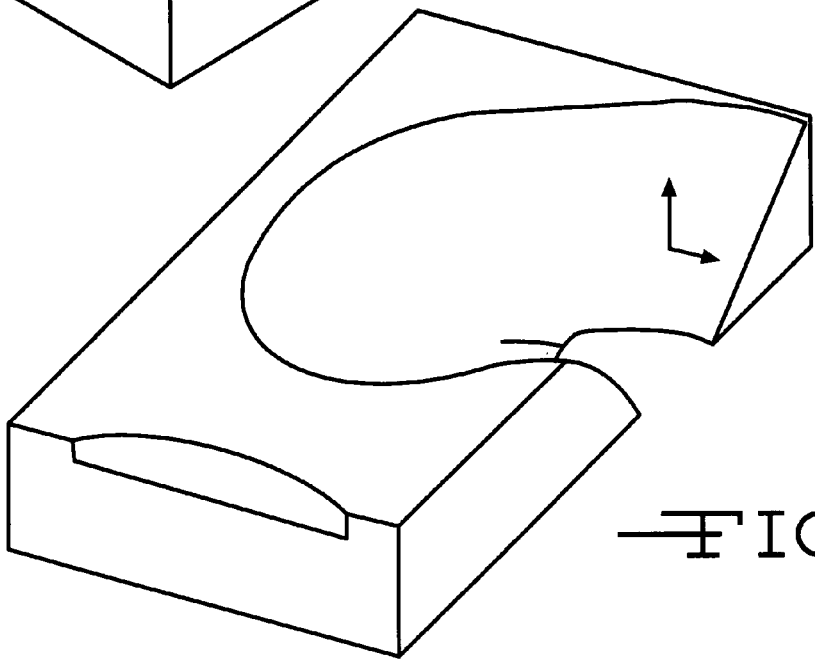
FIG. 15 is a perspective view of pelvic half generic model right with standard gluteus loading and trochanter deloading.

Starting from the three basic pelvic half models (1, 2 and 3), one generic pelvic half model (in S, M and L) for the left (L) and the right (R) pelvic half may be developed (see FIG. 15). This generic pelvic half model may be characterized, for example, by a:

deloading of the tuber and sacrum half;

deloading of the trochanter;

standard loading of the gluteus muscles; and standard loading of the ramus inferior ossis pubis.

Using inserts (e.g., a trochanter insert for standard trochanter loading and a gluteus insert for extra gluteus loading), the three basic pelvic half models can be built up from the generic pelvic half model. Starting from the composed three pelvic half models, nine sit-cushion models can be made (in S, M and L). The composed sit-cushion models may be entrapped in an envelop, or container.

The complete generic sit-cushion assortment (GSA) may exist out of left and right generic pelvic half models in three sizes (S, M and L) with (in-size) accompanying inserts, an entrapping container, and a seat-pan.

The GSA may be a clinical toolkit. On the basis of an inventory of the sit complaints, treatment of the sit complaints may be performed by a test cushion, composed with the help of the GSA. Application of this test cushion may make it possible to clarify objectively if the existing sit complaints can be treated in a medically responsible manner.

Design Trajectory of the Backrest

E. Inventory of three dimensional back measures (e.g., prominent skeletal parts of the pelvic dorsum, the spine and the scapulae). This with the help of the patient load analysis data (registration of three dimensional back measures) and using the measures of three dimensional experimental backrests.

Result: Range of back measures of prominent skeletal parts of the back, for example, in the frontal, sagittal and transversal planes.

F. Design (Three Dimensional Drawing) of the Basic Backrest (Model) in Three Measures, for Example: Small, Medium and Large (S, M and L).

Figure 16:
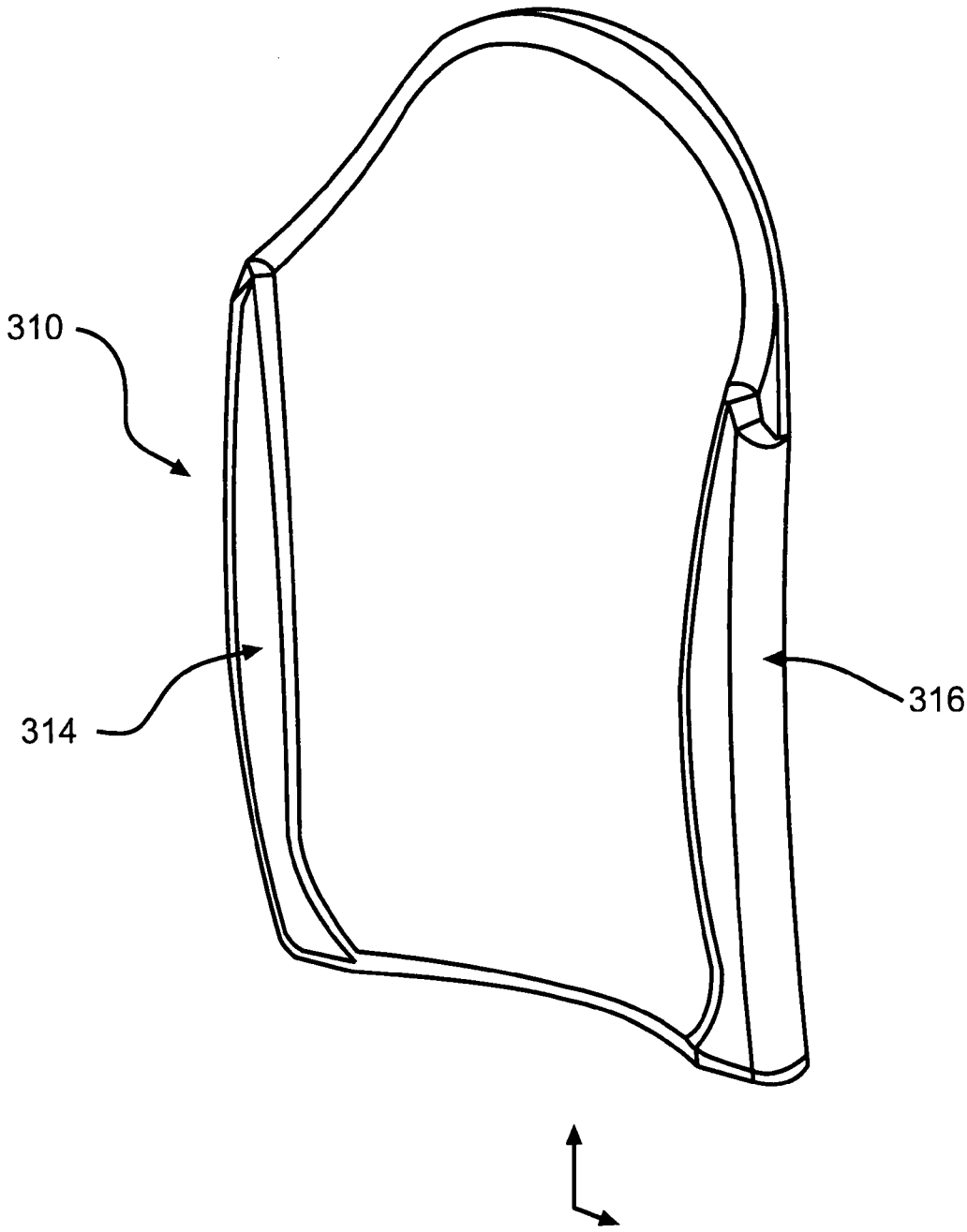
FIG. 16 is a perspective view showing an example of a medium size backrest (i.e., three dimensional basic back shape).

The basic three-dimensional shape of a backrest module 310, which may be made up of a right back half 314 and a left back half 316, as shown in FIG. 16, may be designed on the basis of the outcome of the inventory study of three dimensional back measures (see E above).

To simplify the backrest assortment, three different size models (back shapes) may be described, namely, for example, small, medium, and large (S, M and L) size models. These sizes may be based on measures, for example, in the transversal, frontal and sagittal planes. That is to say, the length of the each size model may be based on the chosen back length in sit (distance between seat surface and Th3) of the user minus the height of the seat cushion (i.e., about 7 cm). For the three model sizes, the back length (see FIGS. 17 and 18) may, for example, be:

L 54 cm.

Figures 17, 18:
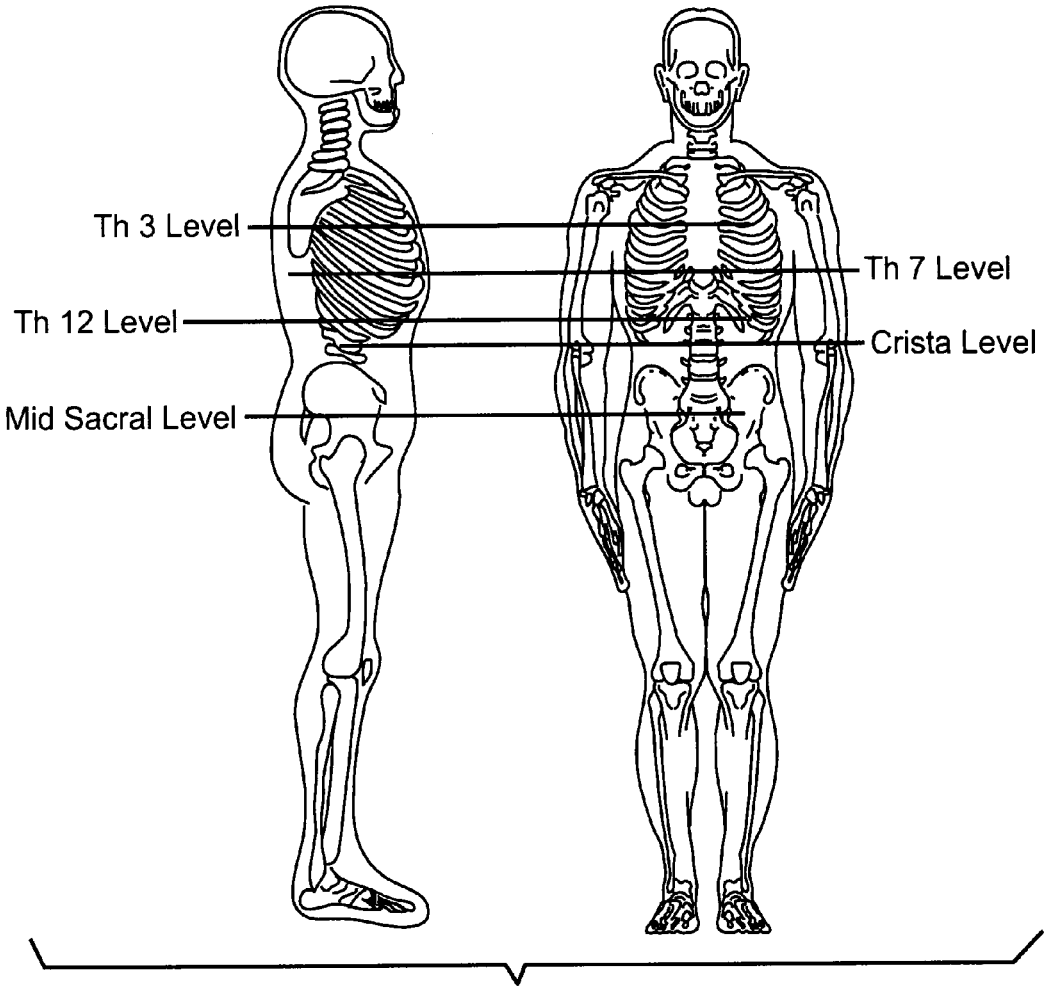
FIG. 17 are diagrammatic representational views, in elevation, showing the three dimensional measures of the back in the sagittal and frontal planes.
FIG. 18 is a table showing the most relevant back measures at the height of the five relevant planes.
Figure 19:
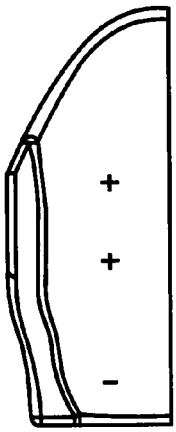
FIG. 19 is a front elevational view of backrest half model 1 (i.e., the right side) with standard gluteus loading, extra loading of the low thoracal wall, and extra loading of the high thoracal wall.
Figure 20:
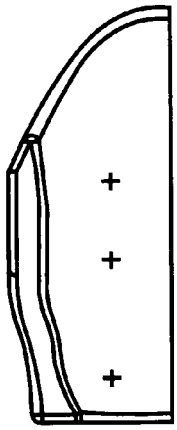
FIG. 20 is a front elevational view of backrest half model 2 (i.e., the right side) with extra gluteus loading, extra loading of the low thoracal wall, and extra loading of the high thoracal wall.
Figure 21:
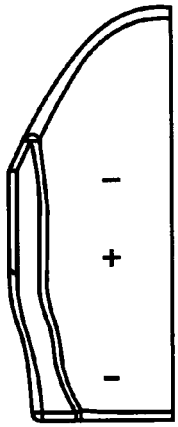
FIG. 21 is a front elevational view of backrest half model 3 (i.e., the right side) with standard gluteus loading, extra loading of the low thoracal wall, and standard loading of the high thoracal wall.
Figure 22:
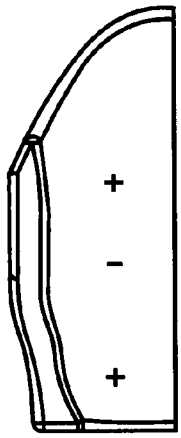
FIG. 22 is a front elevational view of backrest half model 4 (i.e., the right side) with extra gluteus loading, standard loading of the low thoracal wall and extra loading of the high thoracal wall.

The length chosen may be based on the range of back lengths, derived, for example, from the patient load analysis data with back measures (see FIG. 18). Also the following three dimensional-back measures may be based on the mentioned patient load analysis data (see E above).

Also, the width of the back may be scheduled (i.e., reduced to a matrix) (see FIGS. 17 and 18) on behalf of the three sizes. This may be done on three levels:

1. Crista Level

The widths determined may be:

| | |
|---|---|
| S | 31 cm, |
| M | 34 cm, and |
| L | 37 cm. |

2. Th-12 Level

The widths determined may be:

| | |
|---|---|
| S | 28.5 cm, |
| M | 30.5 cm, and |
| L | 32.5 cm. |

3. Th-7 Level

The widths determined may be:

| | |
|---|---|
| S | 31.5 cm, |
| M | 34 cm, and |
| L | 36.5 cm. |

The width on Th-7 level may determine the choice of the size of the model.

The depth of the lumbar lordosis (see FIGS. 17 and 18) may vary between 3 and 4 cm. Herewith the depth has been measured with respect to perpendicular line (see FIG. 17) from the highest point of the thoracal kyphosis (i.e., the highest point of the buttock contour). The following sizes have been chosen, by example:

| | |
|---|---|
| S | 3 cm, |
| M | 3.5 cm, and |
| L | 4 cm. |

Starting with the above-mentioned back measures, S, M and L basic backrest concept models can be developed. FIG. 16 shows an exemplary medium (M) backrest model.

G. Specification of Sit Pathology of the Back Per Back Half

The sit pathology of the back—excessive local loading and/or sit instability can be clearly specified per back half (left and right respectively), using the patient load analyses data, whereby, for example,

- local overloading may:
  - concern in at least 50% of the cases: the ⅔ part proximal of the sacrum;
  - concern in less than 10% of the cases: the cristae iliacae dorsales, the rib bows, the processi spinosi and the scapulae; and
- sit instability may occur:
  - in the sagittal plane: up front/backwards tilting of the trunk; and
  - in the frontal plane: to the left/to the right deviation of the trunk.

Result: Quantitative insight in the location and the severeness of the local overloading of the back and/or the extent and direction of the instability of the trunk.

The following regions or structures of the module (i.e., the left back half and the right back half), using patient load analyses data, can be used as loading options: the dorso lateral side of the thorax wall and the proximal part of the musculi glutei. These loading options may not only be useful within the framework of an unequal pressure and loading distribution of the back but also for the stabilization of the back in the frontal and the sagittal plane (via the musculi glutei and the thorax wall (see FIG. 17). This may be done on behalf of a sit instability in the frontal and/or sagittal plane.

H. Modification of the Designed Three Dimensional Basic Backrest Model Per Back Half On the basis of the insight in the sit pathology (see G above), modifications can be applied in the design of the basic backrest model half.

Modification of the basic backrest model half (with standard loading) on behalf of the treatment of local overloading, for example:

- extra deloading of the sacrum (this is a standard form of treatment).

Modification of the basic backrest module on behalf of the treatment of sit instability, for example:

- in the sagittal plane, the option for extra support at the height of the proximal part of the glutei;
- in the sagittal plane, the option for extra support at the height of the dorso lateral wall of the thorax;
- in the frontal plane, the option for extra support at the height of the proximal part of the glutei; and
- in the frontal plane, the option for extra support at the height of the dorso lateral wall of the thorax.

The above mentioned modifications of the three dimensional basic back shape half (model) have experimentally (from a bio-mechanical perspective) taken place and were judged on their effect on the local sit loading and sit stability by means of sit (back) load analyses in a representative group of subjects. Guided by the results, sit (back) loading profiles with a non-critical load distribution over the back and an adequate sit stability (loading less than 60 mm Hg and shifting COP less than 0.20 cm) can be accomplished.

To simplify the prescription, four basic back half models may be sufficient. The backrest half models are illustrated, for example, in FIGS. 19-22. The basic back half models may be alike with respect the deloading of the sacrum but may differ to the extent in which the musculi gluteï and the thorax wall are loaded. This as follows, for example:

- back half model 1 (see FIG. 19): standard gluteus loading, extra lower thorax wall loading and extra higher thorax wall loading;
- back half model 2 (see FIG. 20): extra gluteus loading, extra lower thorax wall loading and extra higher thorax wall loading;
- back half model 3 (see FIG. 21): standard gluteus loading, extra lower thorax wall loading and standard higher thorax wall loading; and
- back half model 4 (see FIG. 22): extra gluteus loading, standard lower thorax wall loading and extra higher thorax wall loading.

The modifications of the three dimensional backrest model half may make it possible to achieve a specific unequal load distribution over the back with a non-critical sit loading (e.g., treatment of local overload) and at the same time an adequate sit stability.

In as much as a backrest half model does not realize a non-critical load/adequate sit stability, the remaining overload/sit instability can be solved via a manual adaptation of the material (e.g., foam) and construction of the backrest (which are suitable for adaptation).

The foam material of the selected backrest model can be adapted locally by, for example, grinding the foam and/or adding specific inserts: a gluteus insert (for extra loading to treat instability in the sagittal plane), a low thoracal wall insert (for extra loading to compensate instability of the trunk in the frontal plane) and a high thoracal wall insert for extra loading to compensate instability of the trunk in the frontal plane).

Not every theoretical combination (see matrix below) of each half model needs to be selected. Only six backrest models may have a clinical relevant meaning in treating sit pathology. Clinically relevant may be the backrest models which can correct/stabilize the stance of the trunk/pelvis in patients with a sit instability.

| | | | |
|---|---|---|---|
| 1/1 | 1/2 | 1/3 | 1/4 |
| 2/1 | 2/2 | 2/3 | 2/4 |
| 3/1 | 3/2 | 3/3 | 3/4 |
| 4/1 | 4/2 | 4/3 | 4/4 |

Figure 23A:
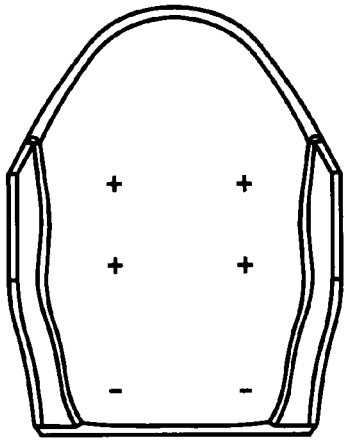
FIG. 23A is a reduced scale front elevational view of a clinically relevant backrest model with extra loading of the lower and higher thoracal walls and deloading of the M. Gluteii.
Figure 23B:
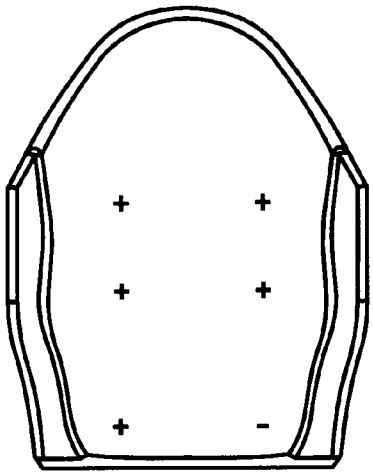
FIG. 23B is a reduced scale front elevational view of a clinically relevant backrest model with extra loading of the lower and the higher thoracal walls and M. gluteus right and deloading of the M. Gluteus left.
Figure 23C:
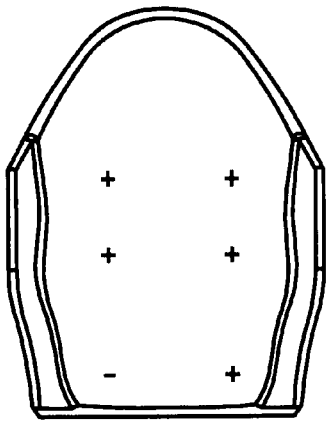
FIG. 23C is a reduced scale front elevational view of a clinically relevant backrest model with extra loading of the lower and higher thoracal walls and M. gluteus left and deloading of the M. Gluteus right.

With a stance impairment, or a reduced functional control over pelvis and/or trunk (i.e., sit pathology), and/or sit instability in patients with a central neurological disease with a high muscle tone (spascisticy)/spasm there may be an indication for model 1/1 (see FIG. 23A), in the case of a symmetry with high tone/spasm, and for backrest model 1/2 or 2/1 (see FIG. 23B), in the case of an asymmetry with high tone (L or R).

Figure 23D:
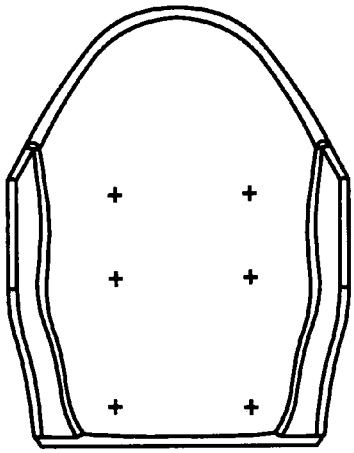
FIG. 23D is a reduced scale front elevational view of a clinically relevant backrest model with extra loading of the lower and higher thoracal walls and M. Gluteii.
Figure 23E:
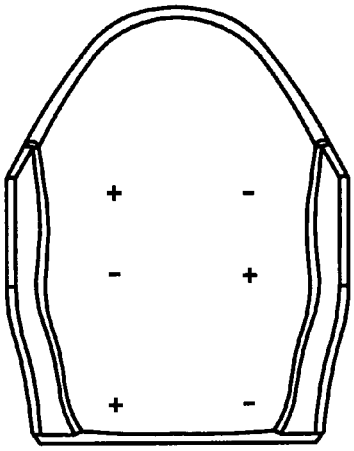
FIG. 23E is a reduced scale front elevational view of a clinically relevant backrest model with extra loading of the higher thoracal wall right and the lower thoracal wall left and the M. Gluteus right. Deloading of the high thoracal wall left, the lower thoracal wall right and the M. Gluteus left.
Figure 23F:
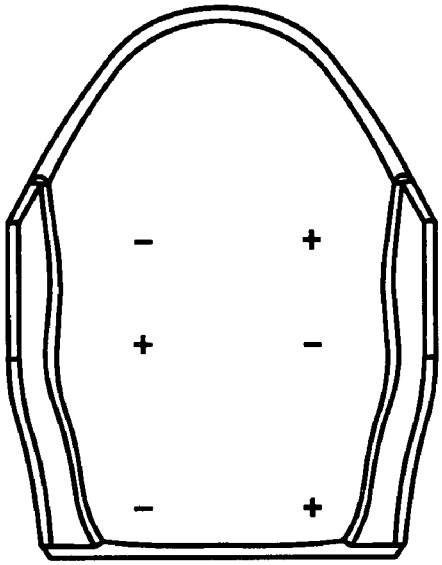
FIG. 23F is a reduced scale front elevational view of a clinically relevant backrest model with extra loading of the higher thoracal wall left and the lower thoracal wall right and the M. Gluteus left. Deloading of the high thoracal wall right, the lower thoracal wall left and the M. Gluteus right.

Symmetrical sit pathology/sit instability on the basis of a neurological disease, without manifest spasticity/spasm, may require the application of backrest model 2/2 (see FIG. 23D). Asymmetrical sit pathology/sit instability, especially on the basis of scolioses, may require the use of backrest model 3/4 or 4/3 (see FIGS. 23E and 23F).

In all backrest models, a standard deloading may take place of the sacrum, the crista iliaca, the spina iliaca posterior superior, the proc. spinae, the lower two ribs (i.e., the floating ribs) and the scapulae.

The combination of the six backrest half models and the three sizes (S, M and L) of these models may result in eighteen (3×6) backrest models.

Figure 24:
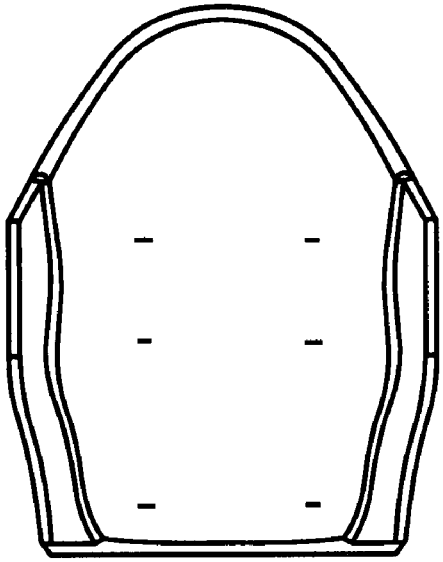
FIG. 24 is a reduced scale front elevational view of a generic backrest model.

Starting with the six backrest models (1/1, 2/1, 1/2, 2/2, 3/4, 4/3) a generic backrest model (see FIG. 24) may be developed.

This generic backrest may characterize itself by:

a deloading of the sacrum, crista spina iliaca posterior superior, the floating ribs, proc. spinae and scapulae; and/or a standard deloading of the M. Gluteii, lower and higher thorax wall.

Through the application of, for example, inserts (for extra loading at the location of the gluteii, the lower and higher thoracic wall), the clinically relevant backrest can be built up and tested on a patient. In this manner, the prescription for the specific model and size (to treat the sit complaints/impairments medically justified) can be verified and made definite.

The complete generic backrest assortment (GBA) may exist out of a generic backrest model in three sizes (S, M and L) with, in the right size, the accompanying inserts and a back pan.

Prescription Procedure

I. Inventory of Sit Complaints/Impairments

To prescribe a seating system, an inventory of sit complaints and impairments may be taken by considering, for example:

1. the danger or presence of local overload (e.g., pain, decubitus or threat thereof, or scar) at the location of the back and/or buttocks/upper legs;
2. the presence of sit instability (e.g., sliding underneath, bending forward or deviating towards the left or the right during sitting without the capability to correct the sitting position);
3. tiredness or fatigue; and
4. pathological characteristics of the sit complaints or impairments by considering, as evidenced by stance deviation of the spine (e.g., left or right), stance deviation of the pelvis (e.g., tilting forward or backward), insufficient or no functional control on the spine or pelvis, or abnormal gluteus muscle tonus (i.e., hyper or hypo tonus) or volume (i.e., atrophy).

In relation to 1 and 2 above, investigation of sit complaints can be performed subjectively or objectively by application of the method of sit load analysis.

II. Selection of the Sit-Cushion and/or Backrest Model

Seat Cushion:

The pelvic half models may be selected for each pelvic half (i.e., left and right) based on the inventory of the sit complaints or impairments and accompanying pathology characteristics, by considering, for example, the following:

1. where overload of the tuber and/or sacrum and hence, gluteus hypotonie or atrophy, exists, pelvic half model 1 is selected, unless there is a possible indication that an extra gluteus load is desired (e.g., where gluteus normo or hypertonie exists);
2. where trochanter overload exists, pelvic half model 3 is selected; and
3. where stance deviation of pelvis or spine, disturbance or defect in functional control over spine or pelvis, extreme sacrum overload, or tiredness exists, pelvic half model 2 is selected.

Based on the foregoing prescription, the appropriately left and right pelvic half models may be selected. The left and right half models may form the selected seat cushion model. The size of the model (S, M and L) may be determined by the measure of the hip width.

Backrest

For sit instability and/or stance impairments, or decreased functional control over the spine due to a symmetrical central neurological disease (symmetrical high tone/spasm), backrest model 1/1 may be indicated.

For sit instability and/or stance impairment, or a decreased functional control over pelvis/spine due to an asymmetrical central neurological disease (asymmetrical high tone/spasm, for example, CVA), backrest model 1/2 or 2/1 may be indicated.

For sit instability and/or stance impairments, or decreased functional control over the spine due to a symmetrical neurological disease with a normal/low tone (left and right), backrest model 2/2 may be indicated.

For sit instability and/or stance impairments, or decreased functional control over the spine due to an asymmetrical neurological disease with normal/hypotone or orthopedic disease (e.g., scoliosis), backrest 3/4 or 4/3 may be indicated.

The size of the model is determined by the measure of the Th-7 width.

The basic sit-cushion and/or backrest module may need individual adaptation to the user, as described above.

It should be appreciated that half models of a seating system (i.e., a sit-cushion and a back) can be formed from a single piece of material, by cutting (e.g., by computer numerical control or other cutting method), molding or other suitable manner, rather than being formed from separate pieces that a joined together. That is to say, the sit-cushion and back do not have to be formed from physically separate pieces that are joined together, but rather can be formed from or into a single piece.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A seating system comprising one of a seat module and a backrest module, the one of the seat module and the backrest module having two sections divided along a sagittal plane of the one of the seat and backrest module and configured as a left side model that forms one half of a complete module and is adapted to support the left side of a user and a right side model that forms the other half of the complete module and is adapted to support a right side of the user wherein the sections are separate sections each having a unitary one-piece construction and having mounting surfaces along the length of the sections, the mounting surfaces being joined together along the sagittal plane to form the complete module, the separate sections being selected from a plurality of pre-selected sections that are configured differently to apply an asymmetrical loading with respect to the sagittal plane in order to address a pathological sit complaint of the user and redistribute the supported load of the user.

2. The seating system of claim 1 wherein the at least two sections cooperate to unequally redistribute the load of seated persons.

3. The seating system of claim 2 wherein the load of seated persons is a center of mass force vector applied to the one of the seat module and the backrest module, and the unequal load redistribution is such that the center of mass of seated persons is shifted relative to the one of the seat module and the backrest module.

4. The seating system of claim 3 wherein the one of the seat module and the backrest module is the seat module and the unequal load distribution of seated persons is shifted to a portion of the seat module that supports at least one of a trochanter, a musculus glutei, a rami inferiores ossis pubis, and an upper leg dorsal side of seated persons.

5. The seating system of claim 2 wherein the unequal load distribution reduces the loading of seated persons in one of a bony prominent skeleton part, an ulcer region, and a scar region and increases loading of a soft tissue portion of seated persons.

6. The seating system of claim 2 wherein the unequal load distribution provides a three dimensional stability to seated persons such that a seated person body posture is repositioned.

7. The seating system of claim 6 wherein the three dimensional stability further substantially prevents unintended relative movement between the one of the seat module and the backrest module and a contacting body part of seated persons.

8. The seating system of claim 2 wherein the at least two sections have a stabilizing profile derived from at least one of pathological data, anthropometric data, and anatomical data of seated persons.

9. The seating system of claim 2 wherein the at least two sections are configured to stabilize a pelvic base of seated persons in at least one of a frontal plane, a sagittal plane, and a transverse plane.

10. The seating system of claim 2 wherein the at least two sections have a stabilizing profile derived from anthropometric data including one of a hip width, a trochanter width, and an ischial tuberosity width.

11. The seating system of claim 1 wherein the plurality of pre-selected sections are formed from a plurality of pre-selected shapes that are part of a seat assembly toolkit.

12. The seating system of claim 11 wherein the toolkit includes at least one insert, the insert configured to modify the contour of at least one of the pre-selected cushion shapes.

13. The seating system of claim 12 wherein the insert is one of a sacrum bridge, a buttock bank, a hip endo/exo facilitator, a hip endo/exo preventor, a sagittal wedge, a frontal wedge, a diagonal wedge, and a rotation block.

14. The seating system of claim 1 wherein the plurality of pre-selected sections are formed from a plurality of pre-selected cushion shapes that are part of a seat assembly toolkit, the toolkit comprising an assortment of a plurality of different sized sections, the different sized sections being configured to be assembled together to form the left and right half models of one of the seat module and the back module.

15. The seating system of claim 14 wherein the plurality of different sized sections form the seat module, the different sized sections being based on measurements of prominent skeletal parts of a user's pelvic base in at least one of a transverse plane, a frontal plane, and a sagittal plane.

16. The seating system of claim 14 wherein the plurality of different sized sections form the back module, the different sized sections being based on measurements of prominent skeletal parts of a user's back profile including one of a pelvic dorsum, a spine, and a scapula.

17. The seating system of claim 1 wherein the one of the seat module and the backrest module is configured to be modified to treat a localized overloading condition such that the supported load of seated persons is at least partially redistributed to a non-critical loading of one of a buttocks and a back of seated persons.

18. A method of forming a seating system, the method comprising the steps of:

determining which of a seat module and a backrest module requires a configuration to redistribute the supported load of seated persons;

providing a plurality of contoured, pre-formed left and right sections wherein at least two sections are configured as left side models that form one half of a complete module and each being adapted to support the left side of a user and at least two sections are configured as right side models that form the other half of the complete module and each being adapted to support a right side of a user for the determined one of the seat module and the backrest module;

selecting a left side model from the plurality of contoured, pre-selected sections, the selected left side model having a mounting surface along a length of the one of the seat module and the backrest module;

selecting a right side model from the plurality of contoured, pre-selected sections, the selected right side model having a mounting surface along the length of the one of the seat module and the backrest module; and joining the left side model mounting surface to the right side model mounting surface along a sagittal plane to form the complete module such that the complete module is configured to apply an asymmetrical loading with respect to the sagittal plane in order to address a pathological sit complaint of a user and redistribute the supported load of seated persons.

19. The method of claim 18 wherein the step of providing a plurality of contoured, pre-formed sections includes providing at least one insert, the insert configured to modify the contour of the one of the seat module and backrest module.

20. The method of claim 19 wherein the step of providing the plurality of contoured, pre-formed sections and the at least one insert are provided as part of a seat assembly toolkit.

* * * * *